US005372072A

United States Patent [19]

Hamy

[11] Patent Number: 5,372,072

[45] Date of Patent: Dec. 13, 1994

[54] TRANSPORTATION SYSTEM

[76] Inventor: Norbert Hamy, 236 The Kingsway, Etobicoke, Ontario, Canada, M9A 3T5

[21] Appl. No.: 30,246

[22] PCT Filed: Sep. 13, 1991

[86] PCT No.: PCT/CA91/00325

§ 371 Date: Mar. 15, 1993

§ 102(e) Date: Mar. 15, 1993

[87] PCT Pub. No.: WO92/05057

PCT Pub. Date: Apr. 2, 1992

[30] Foreign Application Priority Data

Sep. 13, 1990 [CA] Canada ..... 2025334

[51] Int. Cl.[5] ..... B61B 3/00

[52] U.S. Cl. ..... 104/93; 104/91; 104/119; 104/127; 105/144; 105/154; 105/156; 105/152; 105/149.1; 105/150

[58] Field of Search ..... 104/89, 94, 118, 119, 104/123, 124, 126, 127, 129, 139; 105/141, 144, 148, 149.1, 150, 154, 156, 152

[56] References Cited

U.S. PATENT DOCUMENTS

| | | | |
|---|---|---|---|
| 3,626,857 | 12/1971 | Omar | 104/89 |
| 3,830,338 | 8/1974 | Svensson | 104/89 |
| 4,144,817 | 3/1979 | Morita | 104/93 |
| 4,503,778 | 3/1985 | Wilson | 104/89 |
| 4,781,119 | 11/1988 | Davis | 104/93 |

*Primary Examiner*—Mark T. Le
*Attorney, Agent, or Firm*—Marks & Clerk

[57] ABSTRACT

A transportation system comprises a continuous stationary track having a pair of opposed rigid bearing surfaces, and a plurality of discrete cantilevered load-carrying vehicle units movable beside said track. Each vehicle is coupled to the track by a bogie having a linear arrangement of bogie wheels running between the bearing surfaces. The bogie wheels are mounted on mutually articulated frames and have a diameter slightly less than the separation of the opposed bearing surfaces to allow limited pivoting movement of the frames within the track. The adjacent articulated frames are forcibly urged to pivot in opposite directions within the track between the bearing surfaces such that bogie wheels carried thereby forcibly and alternately engage the respective opposed bearing surfaces at at least three points to ensure a pro-loaded positive coupling between the bogie and the track.

37 Claims, 19 Drawing Sheets

TRANSPORTATION SYSTEM

This invention relates to a transportation system, and more particularly to a system of capable of providing high capacity lateral transportation in downtown core areas or vertical elevator transportation in high-rise buildings.

Conventional high capacity urban transportation systems generally employ underground trains or street cars moving along conventional rails. Such systems take up a considerable amount of space in the urban area and do not allow the individual cars to be separately directed. Furthermore, such systems cannot be used to provide vertical transportation in such applications as elevator shafts. Many alternative local systems for specialized applications, such as mono rails, ski lift systems and the like are known, but such systems are not generally suitable for widespread use in downtown core areas. Mono rails are generally used in localized applications, such as exhibition grounds and the like, and like conventional transportation systems the cars are coupled together in the form of a train. The trains cannot be conveniently switched between tracks. Furthermore, they cannot be used in vertical applications. Ski lift systems are generally cable based and are not suitable for use in urban areas.

U.S. Pat. No. 4,690,064 discloses a transportation system with a continuous stationary track having a pair of opposed rigid bearing surfaces and a plurality of discrete cantilevered load carrying vehicle units movable beside the track. Each vehicle is coupled to the track by means of a simple bogie arrangement running in a C-shaped guide. This arrangement does not allow convenient switching between tracks, neither does it allow the vehicles conveniently to move in vertical and horizontal directions.

An object of the present invention is to provide a more versatile urban transportation system that has hitherto been impossible using systems of the prior art.

According to the present invention there is provided a transportation system comprising a continuous stationary track having a pair of opposed rigid bearing surfaces, and a plurality of discrete cantilevered load-carrying vehicle units movable beside said track, each said vehicle being coupled to said track by means of a bogie having a linear arrangement of bogie wheels running between said bearing surfaces, said bogie wheels being mounted on mutually articulated frames and having a diameter slightly less than the separation of said opposed bearing surfaces to allow limited pivoting movement of said frames within said track, and urging means for forcibly urging adjacent articulated frames to pivot in opposite directions within said track between said bearing surfaces such that bogie wheels carried thereby forcibly and alternately engage said respective opposed bearing surfaces at at least three points to ensure a pro-loaded positive coupling between said bogie and said track.

Preferably, the bogie wheels are arranged in pairs on respective frames, the adjacent frames being interconnected by means of articulated links. In the preferred embodiment, each bogie consists of three pairs of bogie wheels, each pair being mounted on respective articulated frames urged apart by hydraulic rams. The adjacent frames are preferably interconnected by a linkage that allows pivotal movement about the X-Y axis, but prevents rotational movement about the Z axis, the Z axis lying parallel to the direction of movement of the bogie system. A drive motor is preferably mounted on the central frame, with drive motion being transmitted through to the outer frames via a constant velocity universal joint.

The load carrying vehicle units are preferably passenger cabins connected to the bogies by a rotational coupling that allows the passenger's cabin to remain in the vertical orientation while the attitude of the bogie changes as the direction of the track changes in the vertical direction. The transportation system can thus be used as a continuous-loop elevator system, for example in high-rise buildings, or in a combined system that provides both horizontal and vertical modes of transportation.

The passenger cabins are preferably connected to the bogies by laterally displaceable links. This allows the passenger cabins to be swung out of the way at loading and unloading stations to permit following units to pass the units at the stations, which are on side switch-out tracks.

The urban transportation system is highly versatile. It can be used in both horizontal and vertical configurations, and a combination of the two. For instance, in high-rise buildings the system can be embodied in the form of a continuous loop. In lateral transportation systems, the cabins can move in convenient trenches, which take up considerably less space than conventional subway systems. The individual cabins can be easily switched onto different tracks to separate destinations.

The system is particularly useful in high density downtown core areas, where a number of vertically spaced parallel tracks can extend onto different main floors of very high capacity (for example 200,000 people) buildings.

The cabin and bogie configuration is unique in its function of mobility, directional control, track interface, suspension, and flow extraction. The track system is also unique in its structural simplicity, universality of application in the transport sphere, and its passive operation. There are no moving track parts for any of the required switching operations.

The system can operate with a wide range of software trip control packages (headway, trip selection, stops, individualized priority selection). In most applications the system can utilize proprietary programming software which includes a convoy-like flow with "close gap and bump foreword" procedure.

In its preferred embodiment the system features unique self-propelled 10-passenger quick entry/quick exit cabins, which can operate in several different track/shaft installations: vertical, inclined, stepped, horizontal, or combination thereof. The system can be either elevator or rapid transit or elevator/transit PRT combination. This type of performance makes the system a true three-dimensional (or multi-directional) automated Personal Rapid Transit (PRT) system. Every new high-rise (or high density) development can provide a new expanded track network to the general public transit system. The self-propelled cabins can be made part of the publicly funded transit system, with private developers providing only the shaftspace and the new standardized track. In this way transport costs are split between the private and public sectors, while the track network continually expands (proportionally to new development. The track network is passive and virtually maintenance-free. The cabins (technology content and maintenance), along with supply, storage and recycle can remain the responsibility of the public authority.

The market for the system reaches far beyond that of present-day elevator technology. The scope can quickly widen to fully-fledged transportion system applications, with increasing economies of scale. The market scope is further enhanced by the fact that the system can operate a variable mix of passenger cabins and freight cabins. With the flexibility of the various software packages, it is easy to operate an automatic goods-distribution system, together with the PRT cabins, on the common 3-D track network. A percentage of cabins (passenger and/or freight) can always be operated by the private sector, together with the majority of public transit cabins. New techniques of fare collection (taxes, magnetic cards, season cards, etc.) will preferably be introduced to match the high-efficiency operating characteristics of the system.

The system is a highly compact full-fledged transport system. In horizontal operation it requires a functional cross-section of only 25 sq. ft.(2.4 sq. m), including track structure. This is a crucial economic factor in future transport planning considerations. Due to its unobtrusive scale and operational silence the system can be tightly integrated with existing facilities. It will be much easier and cheaper to establish this new multi-directional network space, which will largely disappear as part of the building space. Present-day transport systems require very substantial right-of-ways and environmentally compromising support structure. Subways can cost $50 million per mile; LRT's can cost $20 million per mile, mostly due to right-of-way costs. In contrast the system would have typical track installation costs of $ 1,000 ft ($1,000/0.3 m), or $5.2 million/mile at present day costs.

The invention will now be described in more detail, by way of example only, with reference to the accompanying drawings in which.

Figure 1:
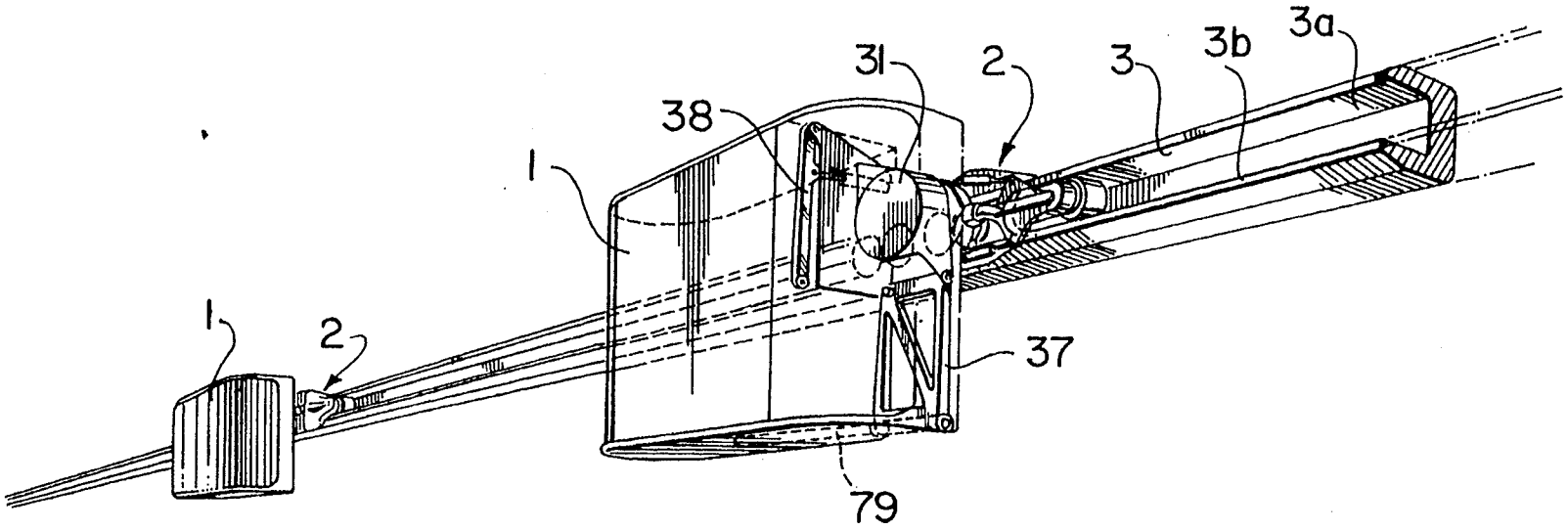
FIG. 1 is a perspective view of passenger cabins moving along a track in the horizontal mode.

Referring now to FIG. 1, the transportation system comprises a series of individual passenger cabins 1, each cantilevered to bogies 2 moving within a rigid concrete C-shaped track 3 having opposed bearing surfaces 3*a*, 3*b*. The self-propelled passenger cabins 1 are individually driven by individual electric drive motors (described in more detail below) carried by the bogies 2.

The passenger cabins 1 are pivotally mounted on the bogies 2 about a horizontal axis to permit the cabins 1 to maintain the same orientation regardless of the orientation of the bogie 2 in the vertical plane.

Figure 2:
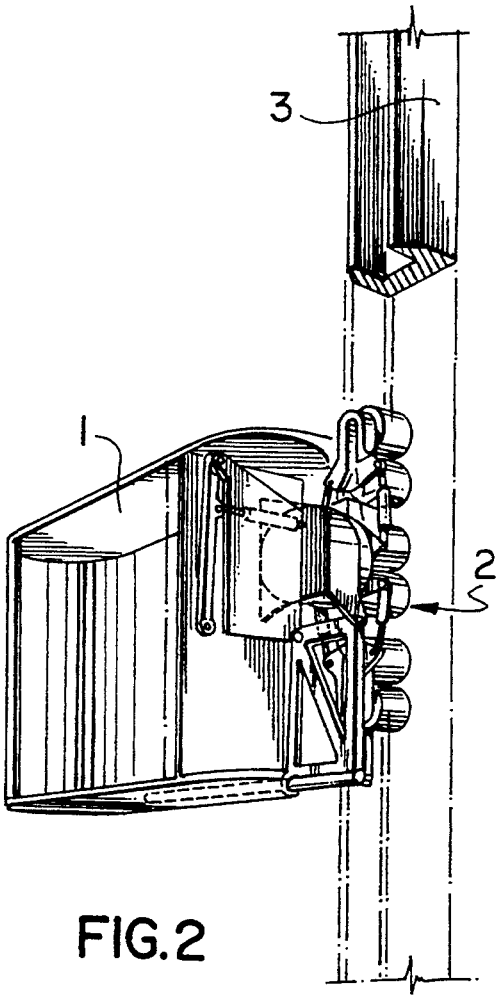
FIG. 2 is a perspective view of a passenger cabin moving along a track in the vertical mode.
Figure 3:
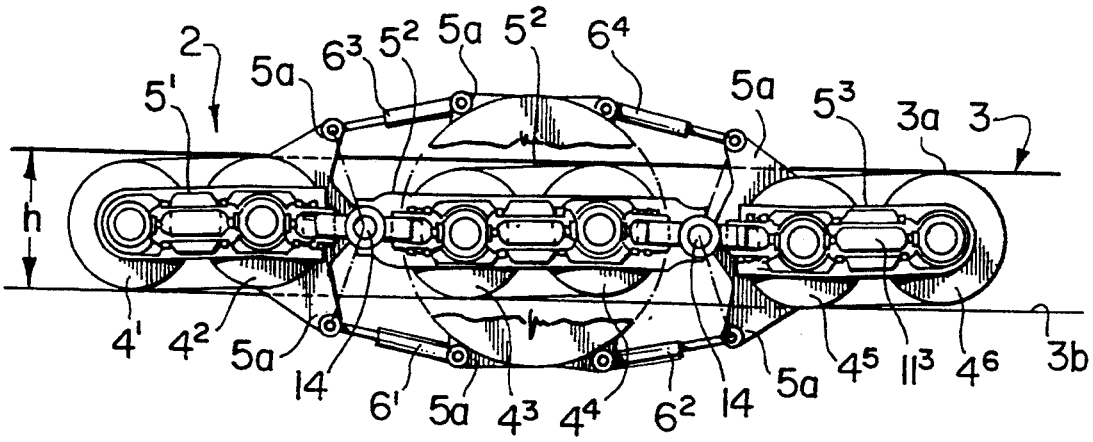
FIG. 3 is a side elevation showing a bogie for a transportation system in accordance with the present invention.

FIG. 2 shows the transportation system in the vertical configuration. Here, the track 3 is vertical. The cabin 1 has pivoted through 90 degrees about the horizontal axis relative to the position shown in FIG. 1, such that even though the bogie orientation has changed, the cabin orientation remains the same. The pivoting action is continuous so that even if the track gradually changes from the horizontal to vertical directions, the cabin gradually turns about the horizontal axis through the bogie, thus maintaining a constant orientation at all times. A control circuit (not shown) is provided to maintain the vertical orientation.

The bogie is shown in more detail in FIGS. 3, 5, 14 and 15. It comprises a linear arrangement of six wheels $4^1 \ldots 4^6$ arranged in pairs on three respective rigid frames $5^1 \ldots 5^3$ articulated to each other in such a way as to allow vertical and horizontal pivotal movement but to prohibit relative rotational movement about an axis parallel to the direction of movement of the bogie along the track. The frames 5 have wing portions 5*a* interconnected by hydraulic rams 6.

The diameter of the bogie wheels 4 is slightly less than the separation h of the bearing surfaces 3*a*, 3*b* such that slight pivoting movement of the bogie pairs between the bearing surfaces 3*a*, 3*b* is possible. The hydraulic rams 6 are energized to forcibly pivot apart the frames such that the wheels 4 forcibly bear against alternate opposed bearing surfaces, 3*a*, 3*b*. Thus, the wheel $4^1$ is forcibly urged against the bearing surface 3*b*, the wheel $4^2$ is forcibly urged against bearing surface 3*a*, the wheel $4^3$ against bearing surface 3*b*, and so on . . .

In the arrangement shown hydraulic rams $6^1$, $6^2$ are in compression, tending to force the adjacent wings 5*a* apart so that the adjacent frames 5 all tend to pivot in the same sense, i.e. anti-clockwise. Hydraulic rams $6^3$, $6^4$ can be under tension so as to tend to draw the adjacent wing portions 5*a* together, or alternatively can be unloaded.

Figure 4:
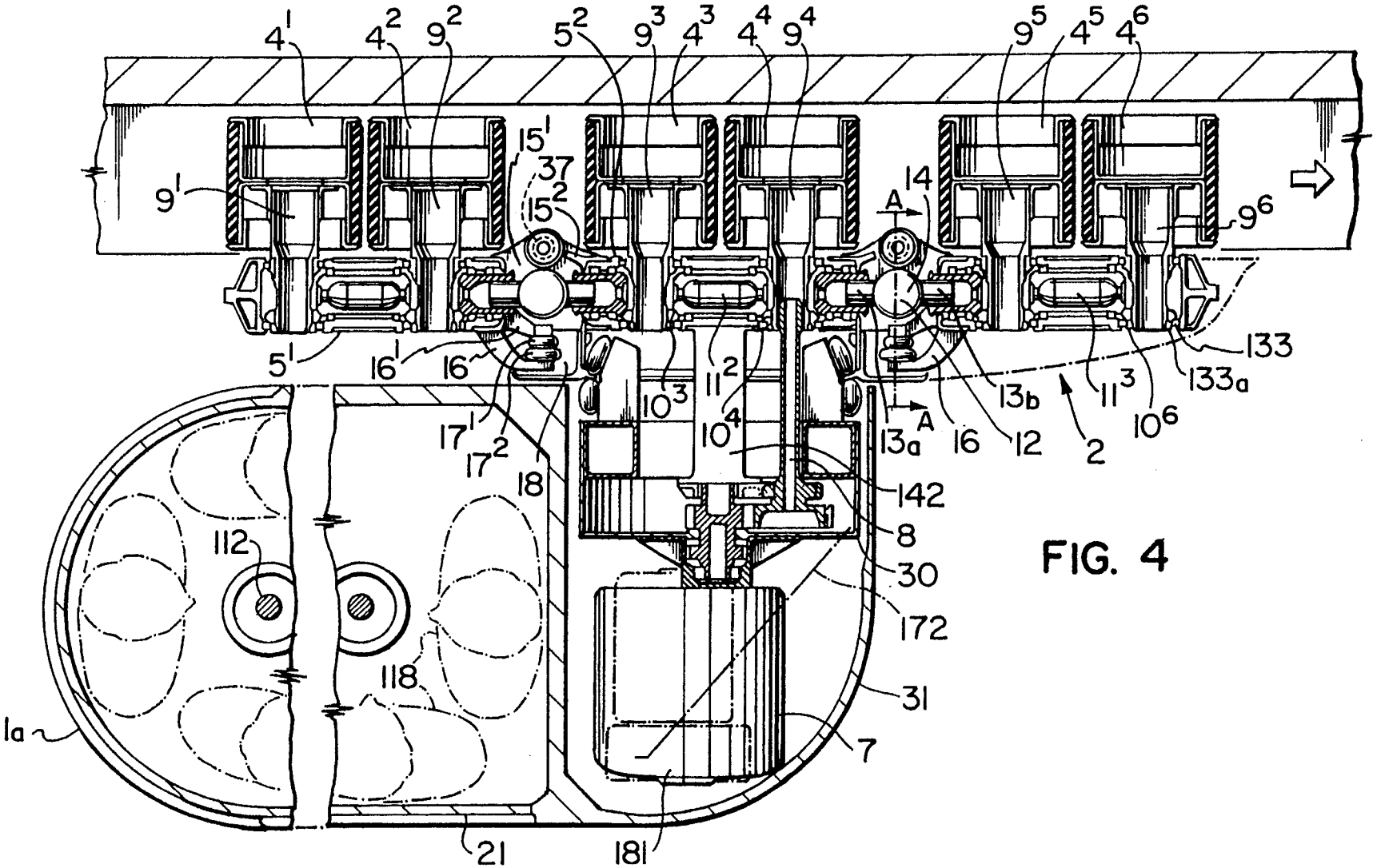
FIG. 4 is a sectional view from above of a bogie and passenger cabin, with the track extending in the horizontal direction.
Figure 5:
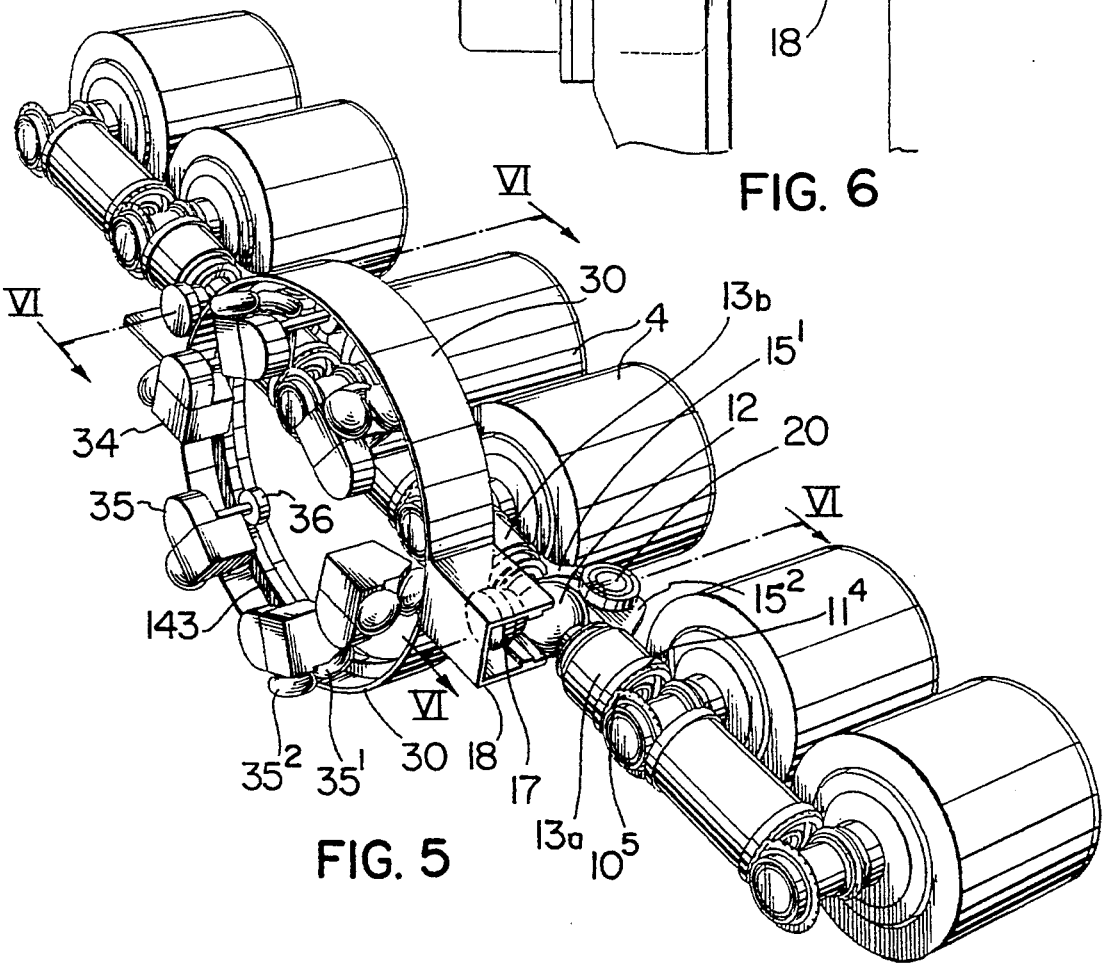
FIG. 5 is a perspective cut-away view of a bogie showing the inter frame coupling arrangements.

Referring now to FIGS. 4 and 5, each bogie 2 is driven by an electric drive motor 7 driving, through a gear train, an input drive shaft 8 for the bogie. Each bogie wheel 4 is mounted on an axle 9 retained by means of wheel bearings 133 and wheel shaft thrust bearings 133*a*. The axle $9^4$ of the bogie $4^4$, which is co-axial with the input drive shaft 8, is directly connected to the latter to drive it in rotation. Axle $9^4$ carries a bevel gear $10^4$ intermeshing with free-running longitudinal double bevel transfer gear $11^2$ to transmit drive through to bevel gear $10^3$ fixedly mounted on axle $9^3$ of bogie $4^3$. On the other side of axle $9^4$, the bevel gear $10^4$ transmits drive through universal joint transfer bevel gear 12 to axle $9^5$, from where drive is transmitted through to axle $9^6$ through bevel gear $11^3$ and bevel gear $10^6$ carried on shaft $9^6$. Drive is transmitted to the wheels of frame $5^1$ in a similar manner.

The universal joint transfer bevel gear 12 comprises a split bevel gear coupling having half-sections 13*a*, 13*b* on either side of a constant velocity universal joint 14. In this way rotational drive can be transmitted from one frame to the next without interfering with the relative pivotal motion of the adjacent frames 5. Bevel gear $10^4$ mounted on axle $9^4$ drives split gear section 13*a*in rotation about a longitudinal axis parallel to the direction of motion of the bogie. This rotational motion is transmitted through constant velocity universal joint 14 to the second section 13*b* where drive is transferred to axle $4^5$ through associated bevel gear $10^5$.

The transfer gear 12 permits the transfer of rotational drive between the adjacent drives of the bogie while permitting articulation about three axes. This articulation is constrained about the longitudinal Z axis. As can be seen more clearly in FIGS. 5 and 6, on one side of the transfer gear 12 is a pair of arms $15^1$, $15^2$ connected respectively to adjacent frames $5^1$, $5^2$. The arms are interconnected by means of a steering ball joint 20. On the other side of the transfer gear 12 is an arm 16 carrying about an axle 16' a pair of small wheels $17^1$, $17^2$ of different diameter.

Figure 6:
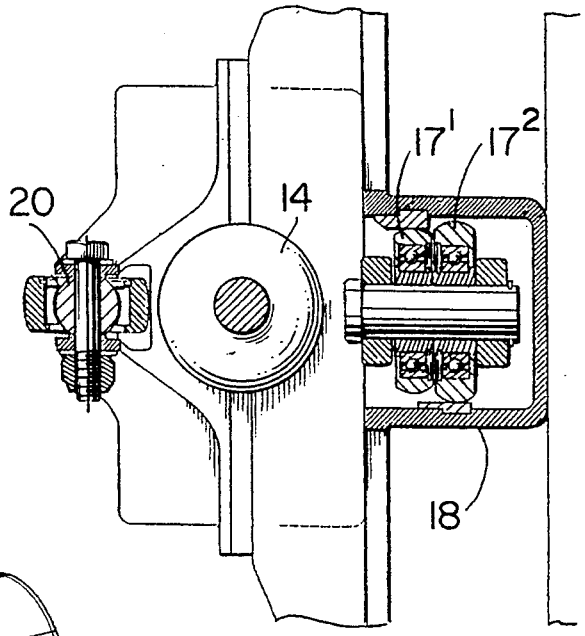
FIG. 6 is a section along line A—A in FIG. 5, showing the steering ball joint.

The wheels $17^1$ $17^2$ are constrained within a C-shaped guideway 18 rigidly attached to central frame $5^2$. Wheel $17^1$ is of smaller diameter than wheel $17^2$. The guideway 18 has an inturned lip $18^1$ on which the smaller wheel $17^1$ bears. The larger wheel $17^2$ bears on the upper surface $18^2$ of the guideway 18. As can be seen in FIG. 6, the tendency of the adjacent frames (not shown) to rotate relative to each other about the longitudinal Z axis is inhibited by the constraints formed by steering ball joint 20 and guideway 18 on either side of the constant velocity joint 14. Ball joint 20 and guideway 18 in effect form two laterally displaced couplings that inhibit relative rotation about the longitudinal axis while permitting relative pivotal displacement, in the X-Y directions.

The passenger cabin 31 shown in FIG. 4 is of stressed-skin torsion box construction. It has a curved end 1*a* with a flexible door 21 that in the open configuration slides around the curved end 1*a* of the cabin. This arrangement provides for maximum transfer rates in and out of the cabin by opening up essentially the whole of one side when the door is open. The cabin i has passenger grab rails 112, viewing ports, lights 117, and passengers 118.

Figure 7:
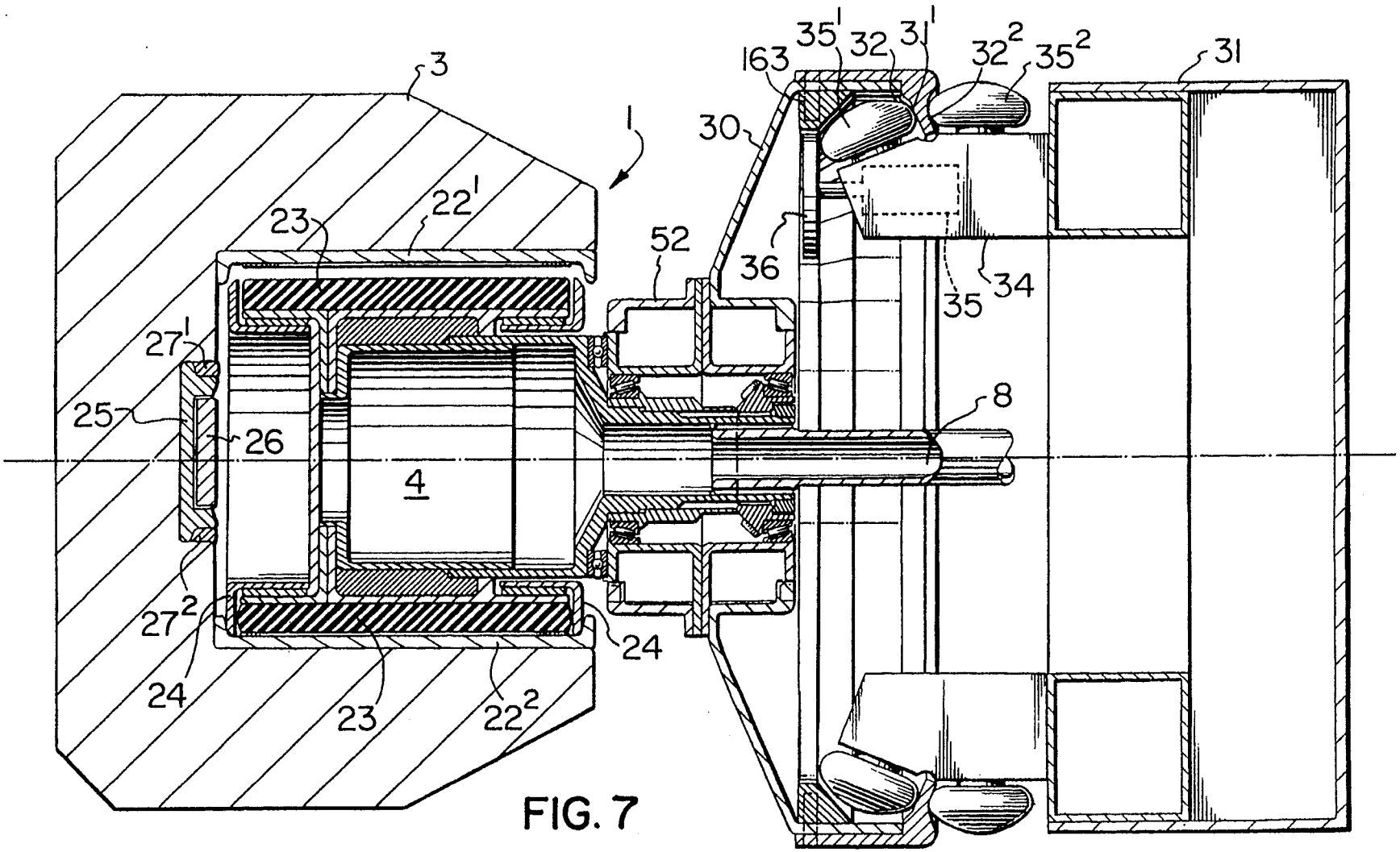
FIG. 7 is a transverse sectional view through a track, bogie and vehicle support drum.
Figure 8:
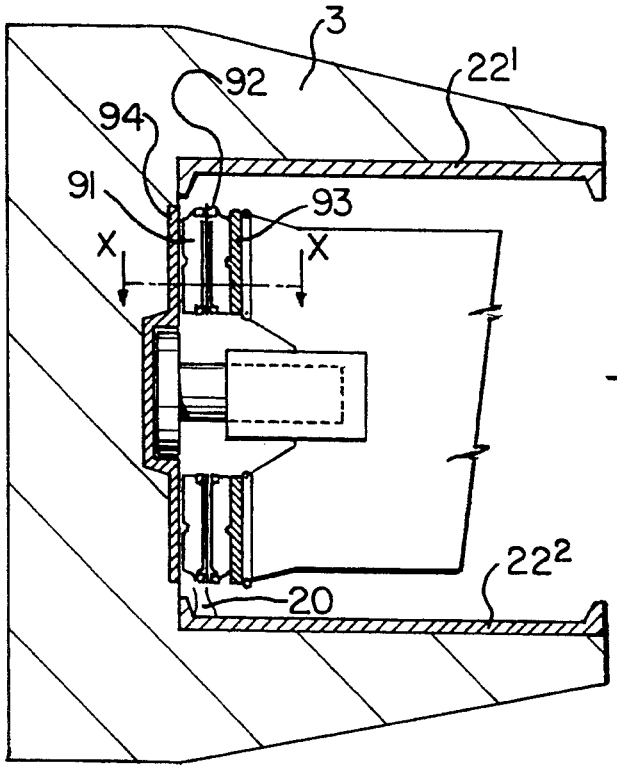
FIG. 8 is a section through track showing a fail-safe locking device in the event of hydraulic failure.

Referring now to FIG. 7, the reinforced concrete C-shaped track has upper and lower steel flange contact channels $22^1$, $22^2$ for engaging bogie wheels 4, which have a central traction tire 23 with sprung steel support and guide flanges 24. The end wall $3^1$ of the track 3 carries a recessed rack 25 engaging a pinion 26 carried on the axle of the bogie 4. The rack and pinion can serve as a safety mechanism in the event of failure of the hydraulic mechanisms urging the bogie wheels 4 against the bearing surfaces of the track 3. By locking the pinion 26, which is engaged with rack 25, the bogie can be prevented from moving along the track. A fail safe mechanism (to be described below) can be built in to ensure that as soon as hydraulic power is lost in the rams, axles 26 are braked so that the safety mechanism brings the bogie to rapid halt. Power rails $27^1$, $27^2$ are also provided to provide electrical power to the bogie system. These can engage contact wipers (not shown) carried by the bogie frames 5.

The central frame $5^2$ of each bogie 1 is rigidly connected to a cast drum 30 (see also FIG. 5) coupled to a cabin support unit 31. The drum 30 is open at its outer end and has an inturned flange 32 defining opposed bearing surfaces $32^1$, $32^2$. It also carries on its inside surface a ring gear 143.

Cast cabin support member 31 has a plurality of circumferentially spaced fingers 34 (see also FIG. 5) extending into the drum 30. The fingers 34 carry free-running resilient roller members $35^1$, $35^2$ bearing on the respective opposed surfaces $32^1$, $32^2$ of inturned lip 32 of the drum 30. The roller members $35^1$, $35^2$ provide a strong cantilever support for the cabin support member 31 against the drum 30. The cabin support member 31 can rotate about the horizontal transverse axis X, while lateral movement, or pivoting about the longitudinal or vertical axes, relative to the track, is prevented.

Each finger 34 has mounted therein a servo motor 35 driving a pinion 36 coupled to ring gear 33. The servo motors 35 are controlled by control circuitry (not shown) to maintain the cabin attached to the cabin support member 31 in the vertical orientation at all times as the attitude of the bogie varies due to variations in the direction of the track.

Figure 9:
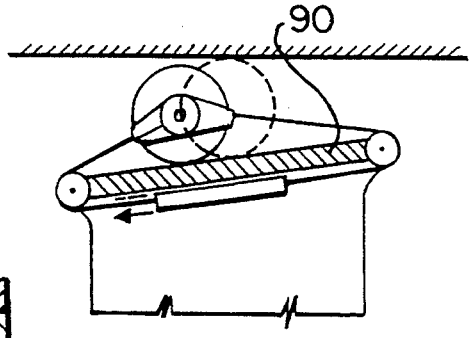
FIG. 9 is a plan view of a bogie with the fail-safe locking device.
Figure 10:
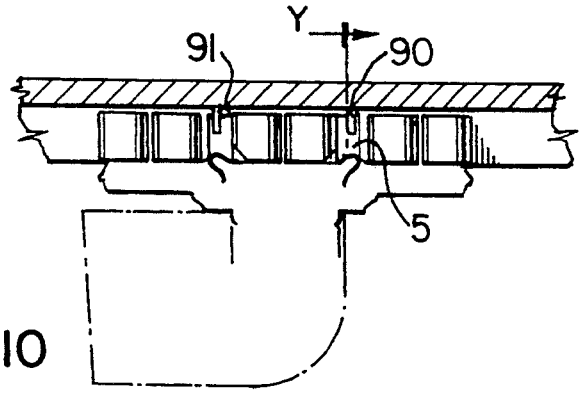
FIG. 10 is a section taken along line X—X of FIG. 8.

FIGS. 9 to 10 show a fail-safe locking device which can be located on the inner end of the bogie wheel 4. This comprises a steel lock roller 91 that co-operates with ramp surfaces 90 carried by the inner face of the frame 5 of the bogie. Rollers 91 can be actuated by means of looped cable actuator 92 or solenoid actuator 93 causing them to become wedged between the ramp surface 90 and steel reaction surface 94 on the inside face of the C-shaped track 3 in the event of hydraulic failure, thus bringing the bogie to a halt.

Figure 11:
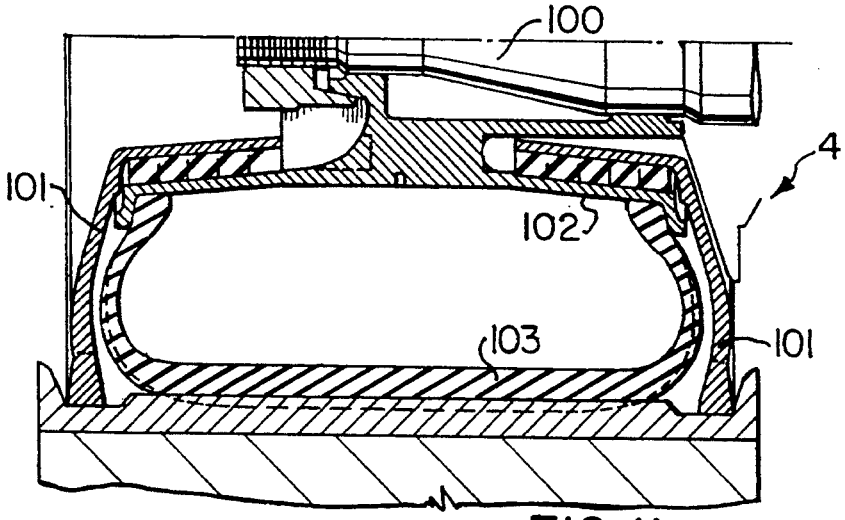
FIG. 11 is a cross section through a part of a bogie wheel, showing the detailed configuration of the wheel.

FIG. 11 shows in detail a part of a bogie wheel 4. It comprises a hub axle 100, a steel flange 101, and a wheel rim 102 supporting a pneumatic tire 103. The tire is loaded and makes contact with steel flange contact channels 22. A steel wheel flange runs in shallow guide channels 220, providing positive location of the wheel within the flange contact channels 22.

Figure 13:
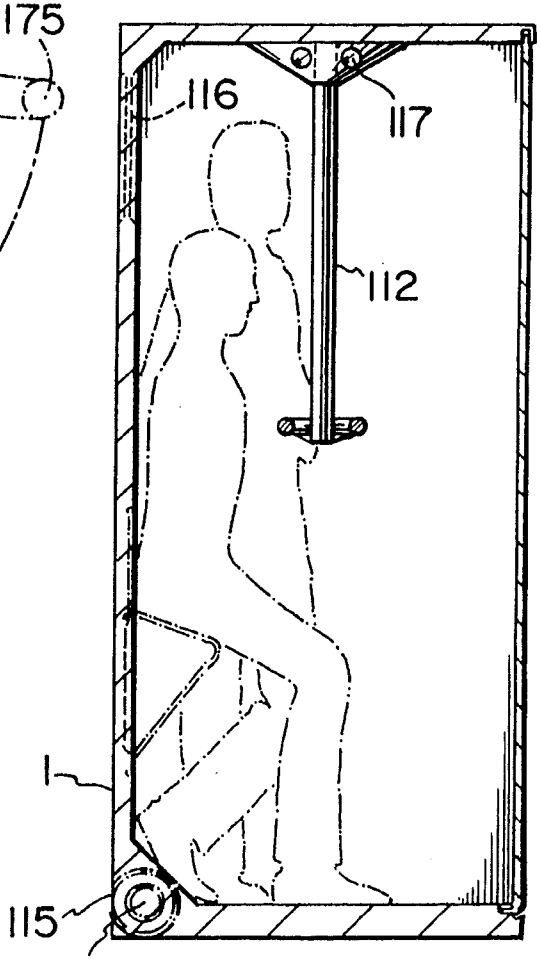
FIGS. 12, 13 show the articulated linkage between the passenger cabin and bogie.
Figure 12:
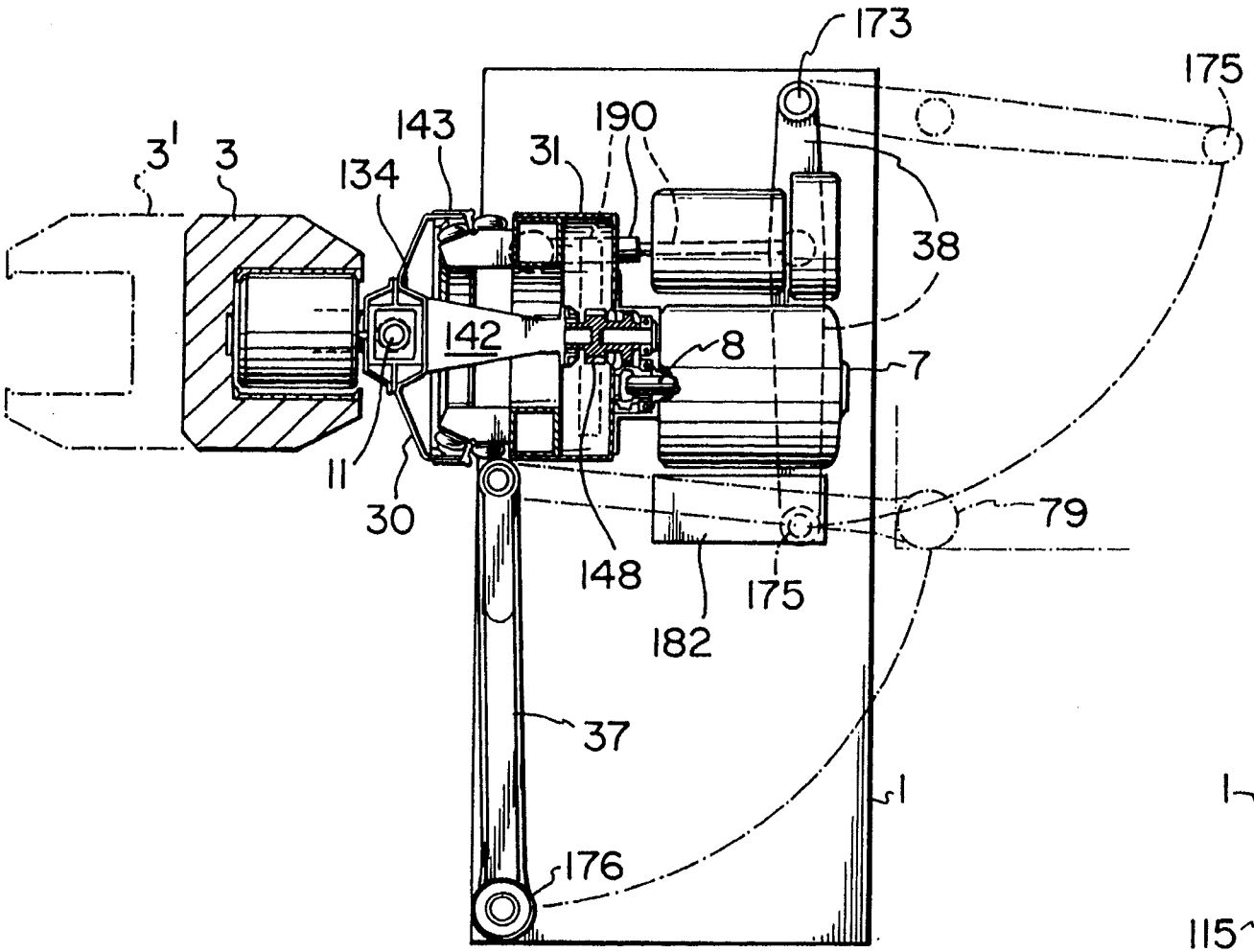
Figure 14:
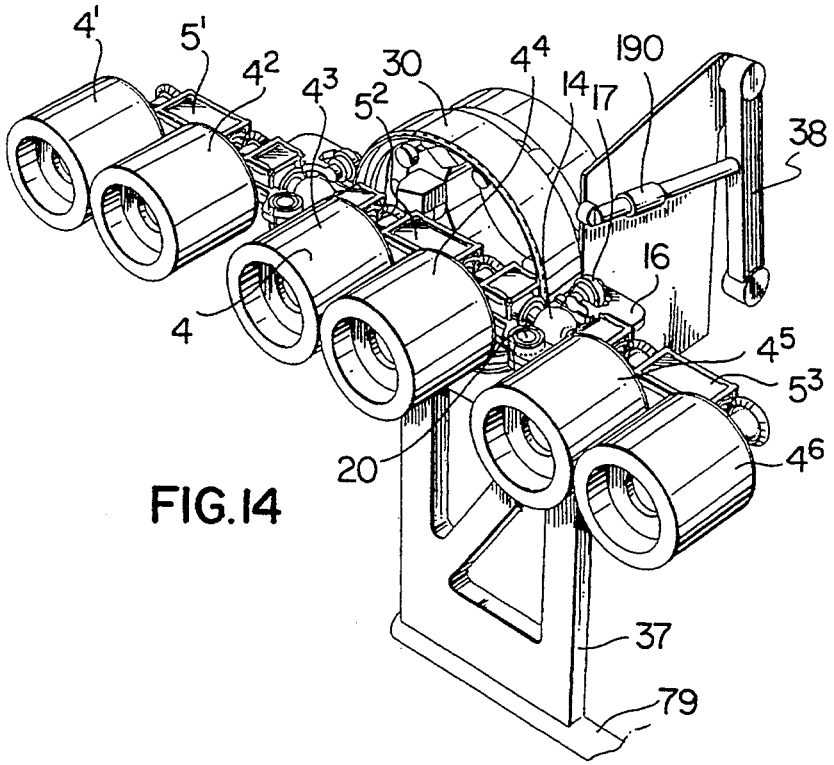
FIG. 14 is a perspective view of part of a bogie showing the drum casting and part of the parallel linkage for coupling the bogie to a cabin.
Figure 15:
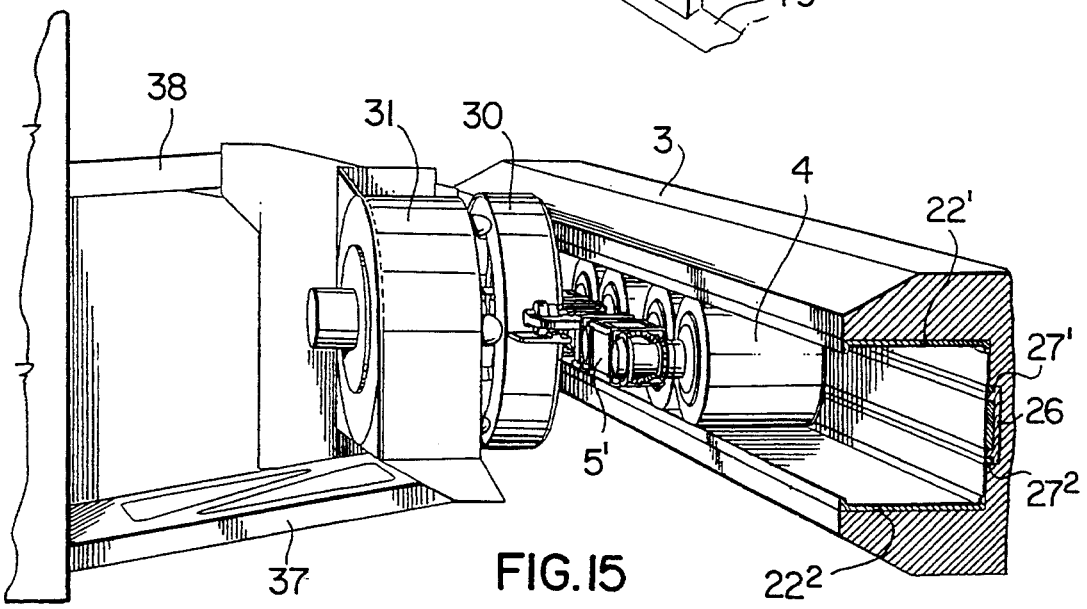
FIG. 15 is a close-up perspective view showing the linkage of the bogie to the support drum.
Figure 16:
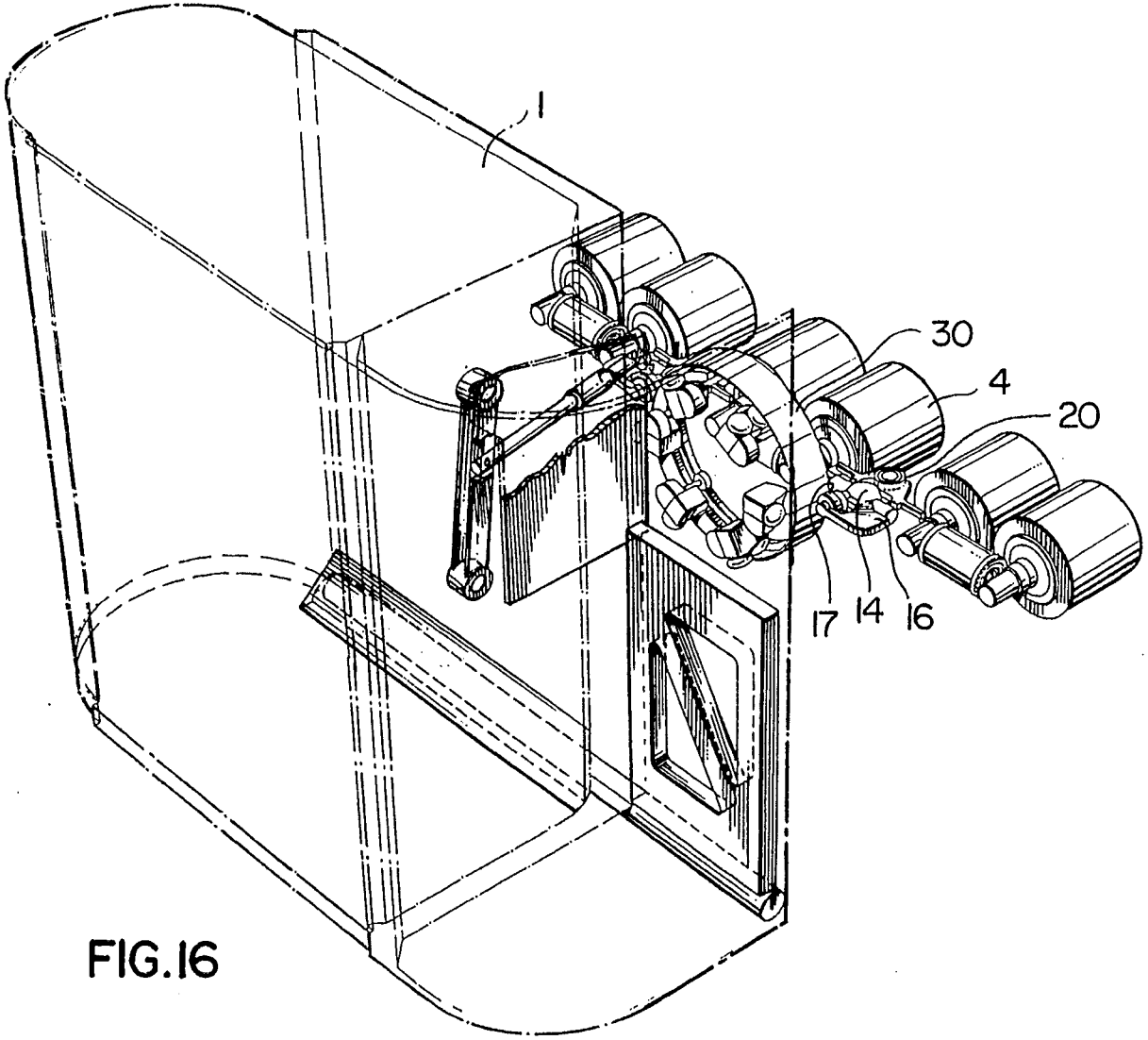
FIG. 16 is a perspective view showing the cabin in relation to the bogie.

Referring now to FIGS. 12 and 13, cabin 1 is connected to the cabin support member 31 by articulated parallelogram links 37, 38. Arm 37 serves as a torsionally rigid primary arm, while arm 38 serves as a secondary arm. This arrangement allows the cabin to be displaced laterally relative to the supporting bogie. The cabin is moved laterally between the normal and shifted positions with the aid of hydraulic ram 190. In an alternative embodiment, the parallel links 37, 38 can be replaced by a hydraulic telescoping arrangement, if desired.

FIG. 12 shows central bogie support spar 142, central bogie alignment ring gear 36, central bogie support flange 144, central bogie support drum 30, which is in the form of a casting, and reduction gear set 148 for reducing the drive from the motor 7 to the drive axle 8.

FIG. 12 also shows how two C-shaped tracks 3, 3′ can be placed back-to-back in a complementary arrangement to provide two parallel systems, possibly running in opposite directions. The second track 3′ is shown in broken lines.

Figure 17:
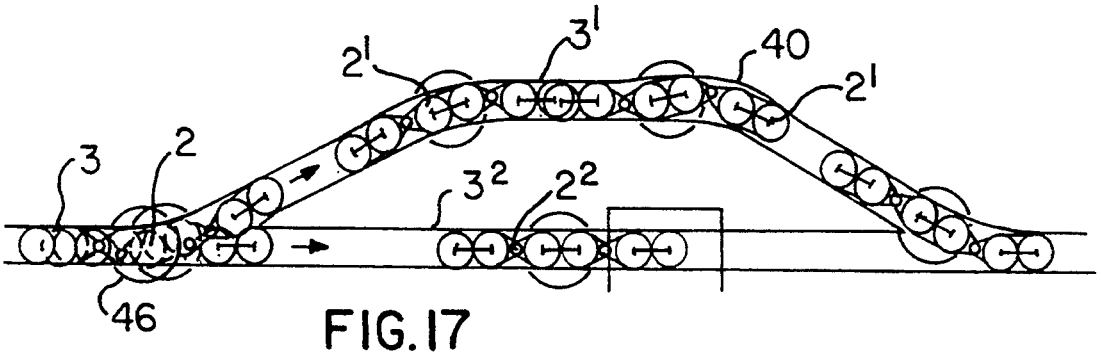
FIG. 17 shows a switch-out track at a passenger loading and unloading station.

FIG. 17 illustrates a track switch. Main track 3 diverges into a station switch-out track $3^1$ and a through track $3^2$. The bogies $2^1$ of cabins passing into the station are switched onto track $3^1$, where the through bogies $2^2$ continue on the through track $3^2$. The switch-out is brought about by actuating the hydraulic rams 6 to direct the leading bogie frame $5^3$ alternatively into the switch-out track $3^1$ or the through track $3^2$ which is permitted by the steering ball joints 20. In order to facilitate the passage of bogie through sharply curved sections, either into the switch-out track or at sharply curved sections of the track, the track is formed with depressions 40 on the outside of the curve. These enable the bogie 2 to pass around the steeply curved portion while maintaining loaded contact at three points at all times. As can be seen, the switching occurs entirely through the pivoting motion of the bogies. There are no moving parts on the track.

Figure 18:
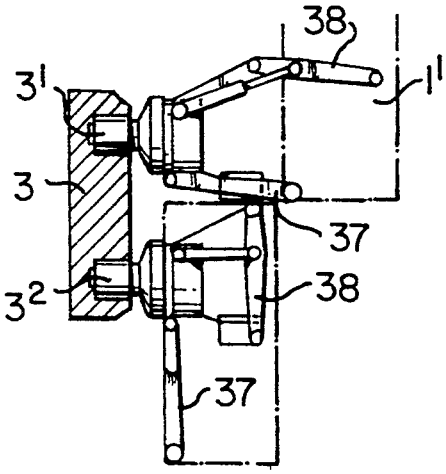
FIG. 18 shows a following cabin overtaking a cabin in horizontal operation.
Figure 19:
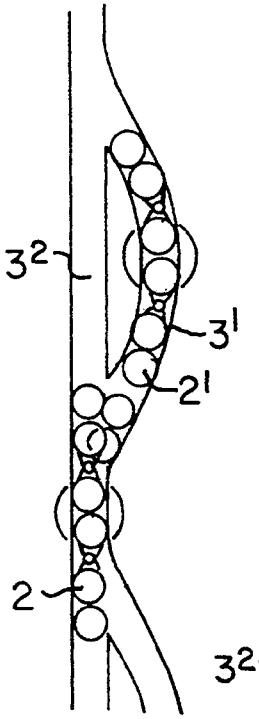
FIG. 19, 20 show switch-out tracks in the vertical configuration.
Figure 20:
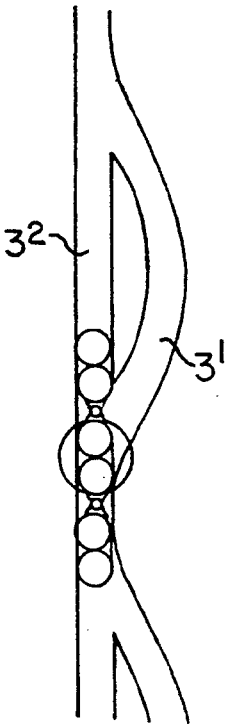
Figure 21:
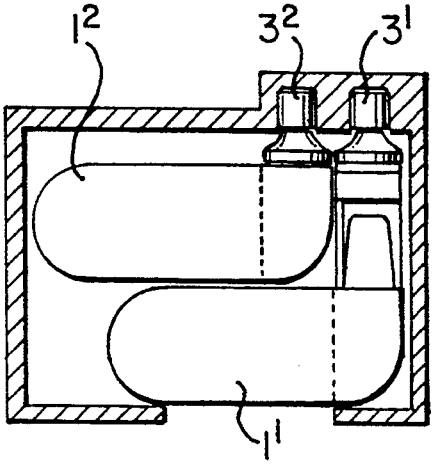
FIG. 21 shows a vertical configuration of the track with a following cabin overtaking a stationary cabin.

At a station, the passenger cabins move into the switch-out track $3^1$, which in horizontal mode is located above the through track $3^2$. By means of articulated links 37, 38, the cabins 1 are displaced laterally into the passenger transfer position $1^1$ (FIG. 18). This enables following cabins $1^2$ to continue on the through track $3^2$, thereby overtaking the cabins $1^1$ in the transfer position. The same principle applies in the vertical mode as shown in FIGS. 19, 20. In the vertical mode, of course the switch-out track $3^1$ is offset to one side of the through track $3^2$, allowing cabin $1^1$ to transfer passengers while cabin $1^2$ overtakes (FIG. 21).

Figure 22:
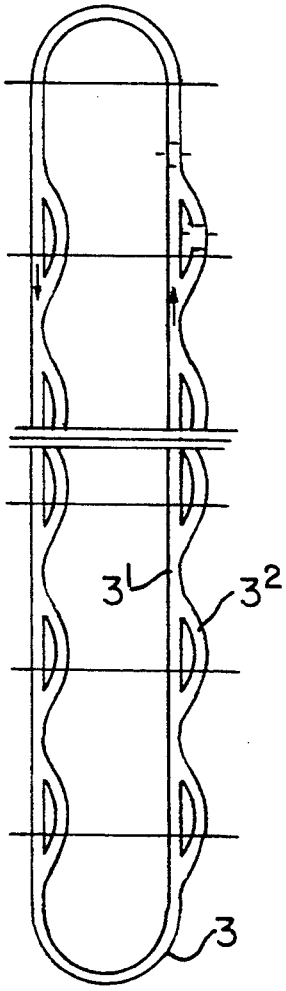
FIGS. 22, 23 show vertical track systems with station switch-outs, and in the case of FIG. 11*b* a horizontal switch-out.
Figure 23:
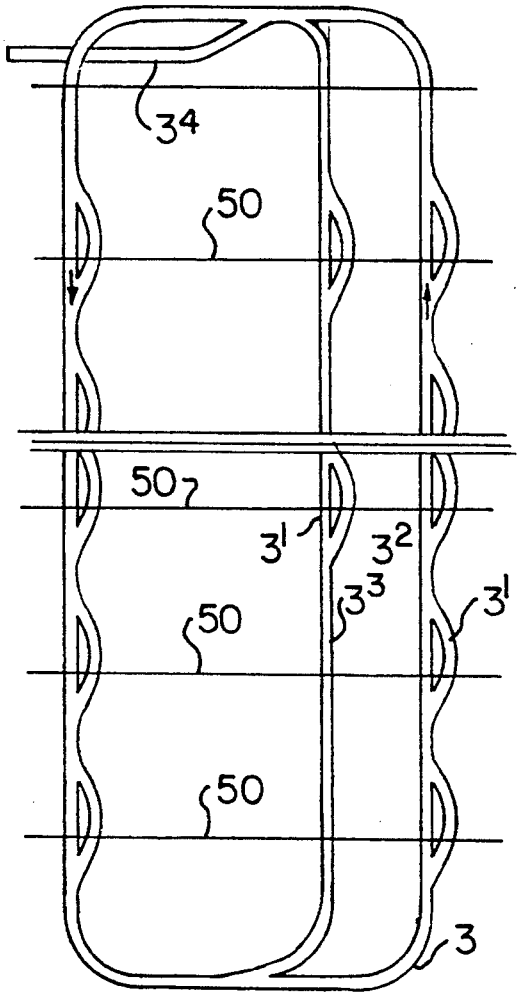

Referring now to FIGS. 22, 23, these figures show an elevator system for use, for example, in a high-rise building. The tracks $3^1$ form a continuous loop with switch-out track $3^1$ located at floors 50. Because of the way the cabins 1 have the capability of overtaking, a series of independent cabins can run around the loop, with cabins switching out at the various floors 50 on the switch-out Tracks $3^1$. One of the features of the described system is that it allows for the provision of one or more express tracks $3^3$ which can go directly, for example, to the third floor. The loop can also be coupled to a horizontal switch-out track $3^4$ enabling the cabins to form part of a lateral transportation system.

Figure 24:
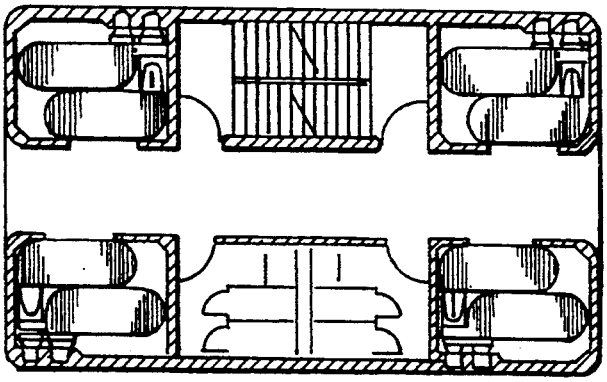
FIGS. 24, 25 show typical elevator stations in the vertical configuration.
Figure 25:
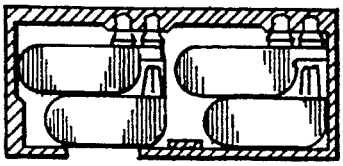
Figure 26:
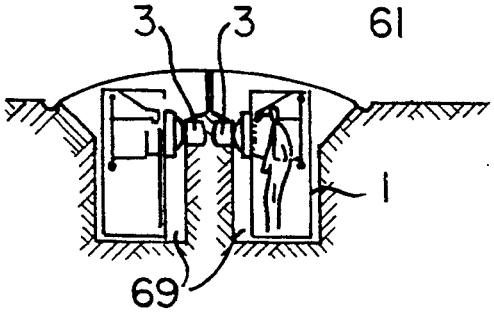
FIGS. 26 to 29 show different track configurations in the horizontal configuration.
Figure 27:
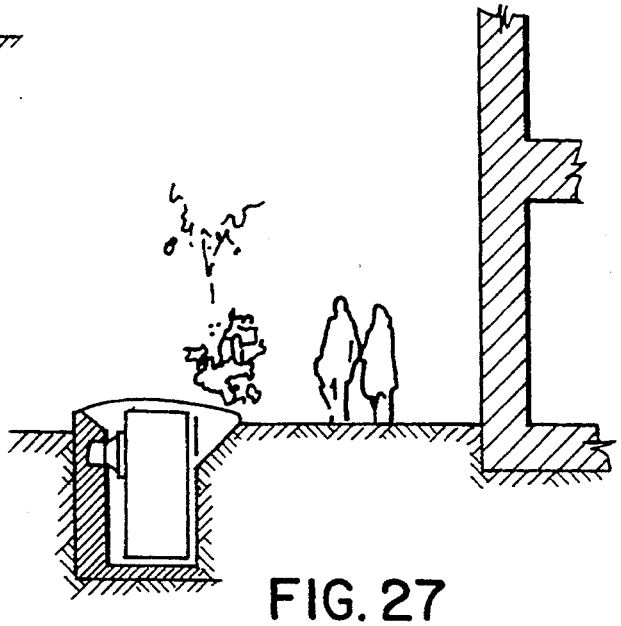

FIGS. 24 and 25 show various configurations of possible elevator stations. Unlike a conventional elevator system, the loops can be arranged in various configurations, as desired.

FIGS. 26 to 29 show how the transportation system can be employed to replace a conventional subway. The cabins 1 can run in surface trenches 60 covered by translucent covers 61. The trenches are relatively economic to dig, in relation to the cost of the subway, and the translucent covers 61 give the passengers an airy feeling.

Figure 28:
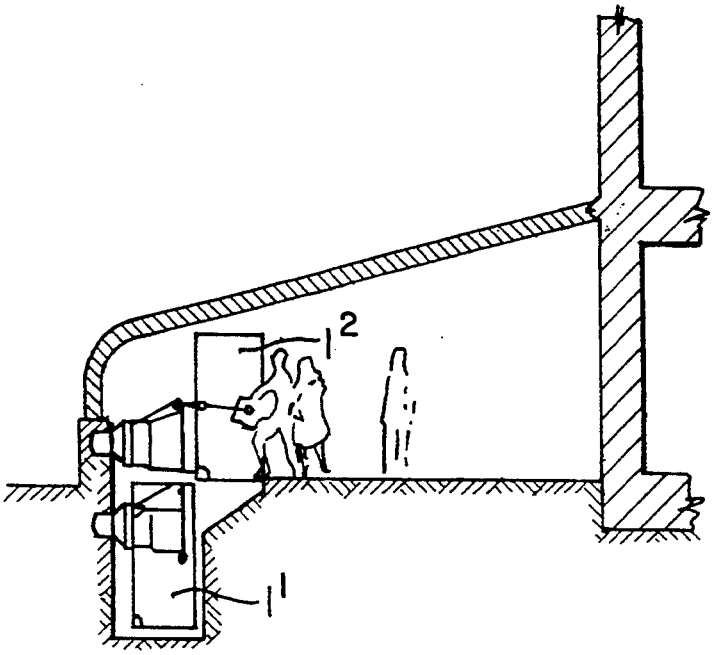
Figure 29:
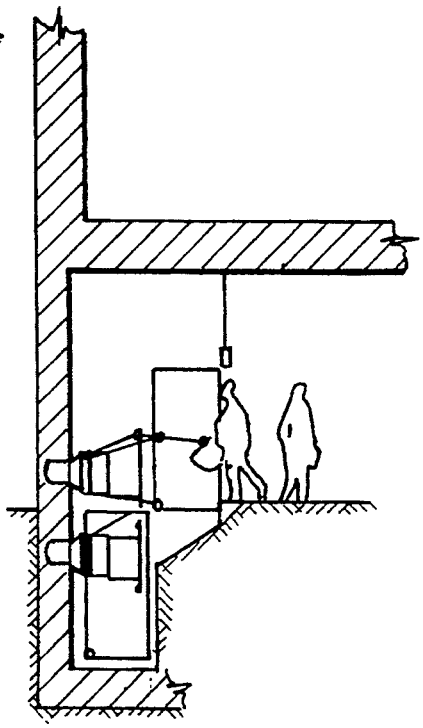

FIG. 28 shows a station in the horizontal configuration. Cabin $1^2$ is raised on the articulated links to the street level so as to allow convenient access for passengers. While passenger access occurs, following cabins $1^1$ can overtake. As shown in 29, the stations can be integrated into buildings.

Figure 30:
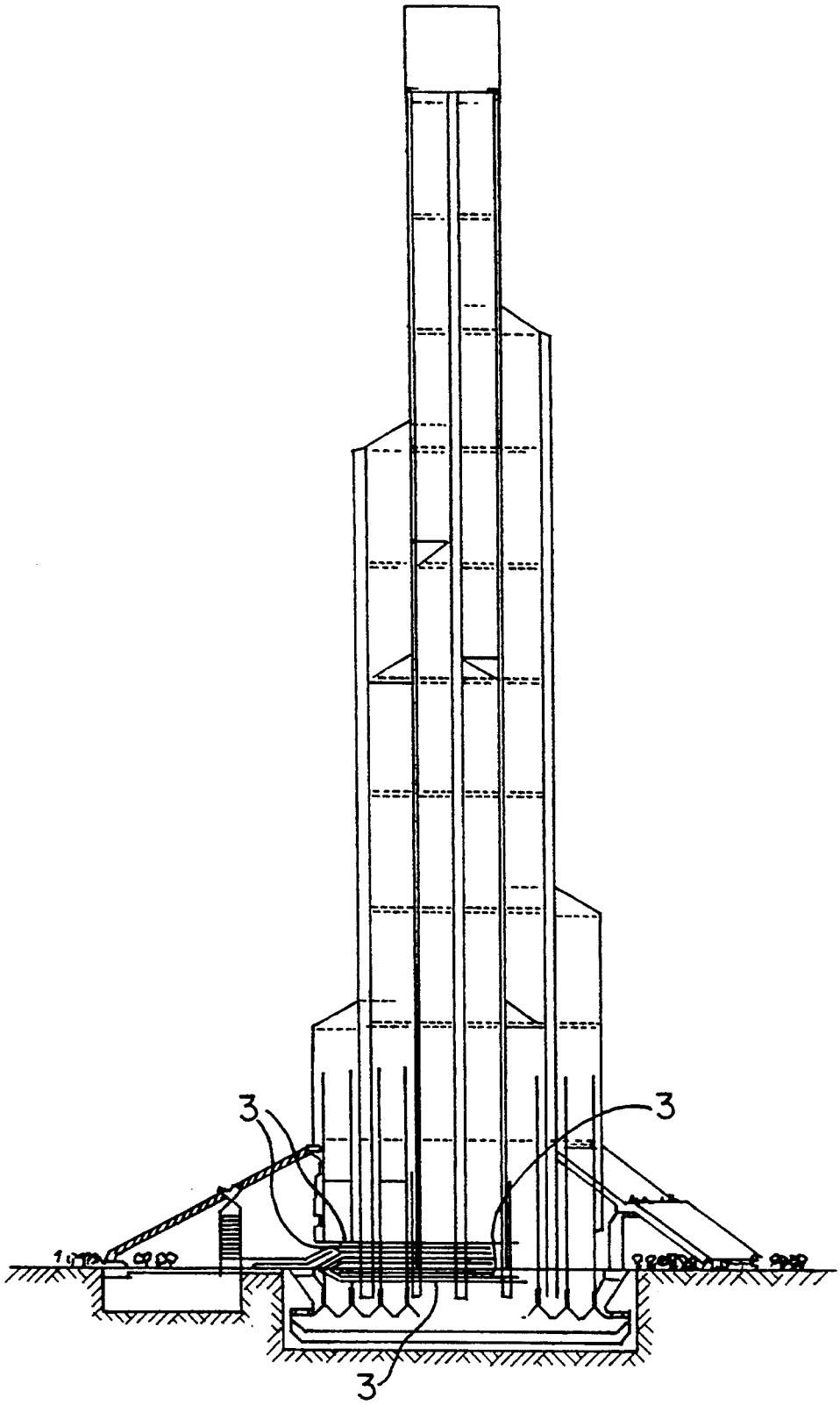
FIG. 30 shows a high-rise megastructure incorporating a transportation system in accordance with the present invention in both the vertical and horizontal modes.

FIG. 30 shows a high capacity, high rise (5,000 foot) office tower of the future. Such towers are being considered for construction in various places, such as Japan, and will have a capacity of approximately 200,000 people. Access is a major problem, and one of the advantages of the present system is that it can provide convenient access to, and evacuation from, the building. In particular a number of tracks 3 can run horizontally onto different lower floor levels, from where the cabins can be coupled directly into the vertical elevator shafts, or passengers can transfer into a separate system. By way of example, the track 3 can run horizontally into the lower ten floors of the building, thereby making each of these floors a primary access level.

Figure 31:
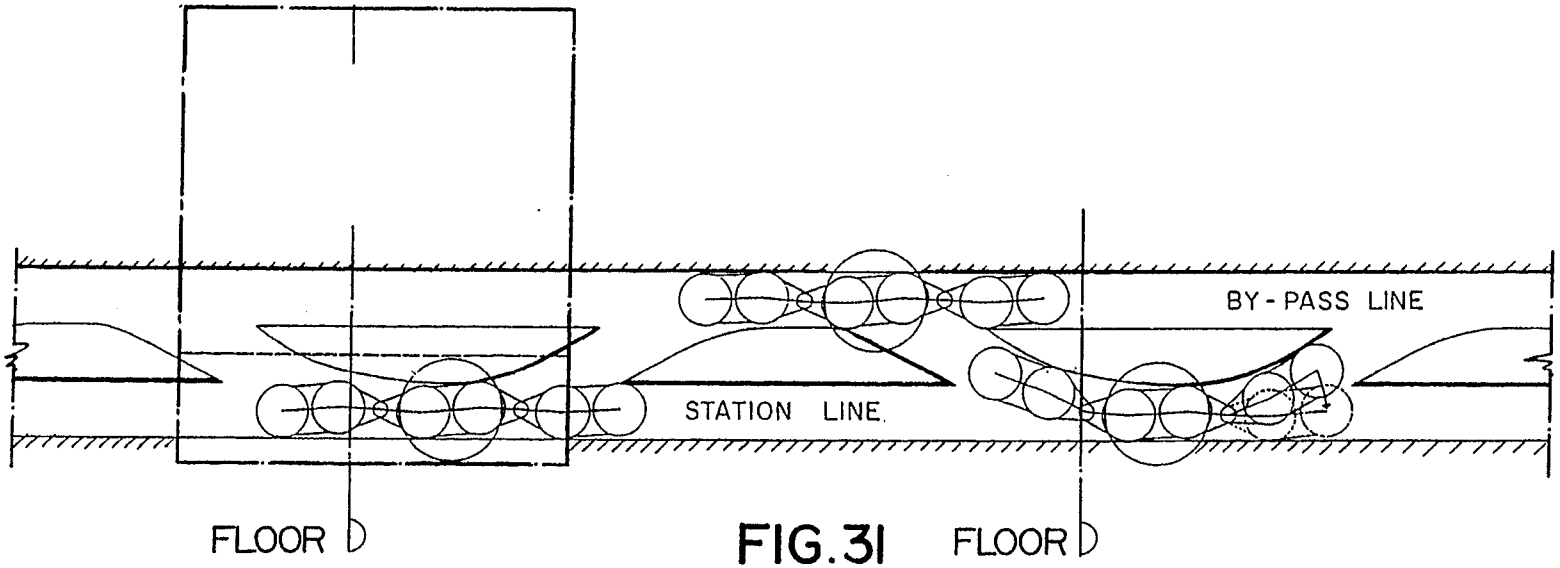
FIGS. 31 and 32 are diagrams showing the various bogie positions for a vertical track configuration.
Figure 32:
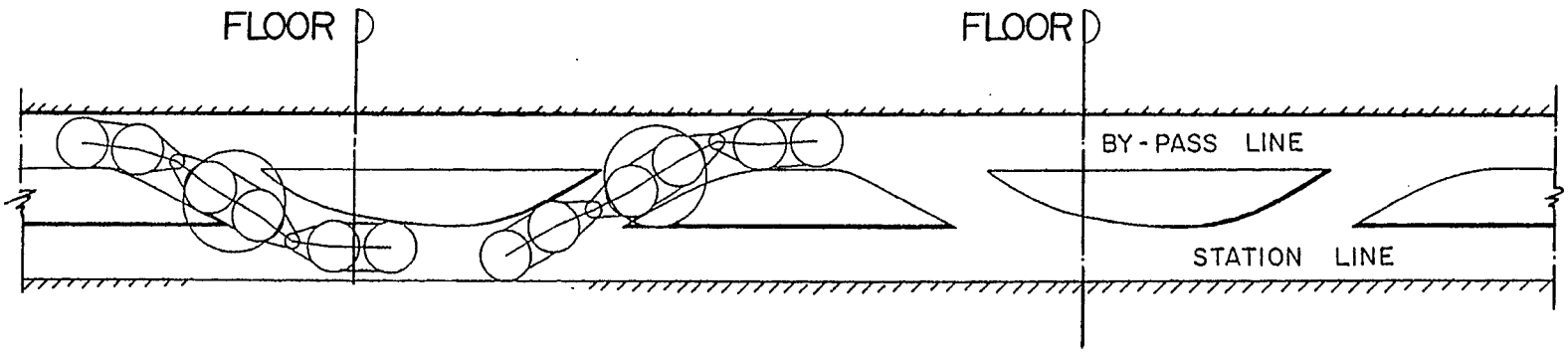
Figure 33:
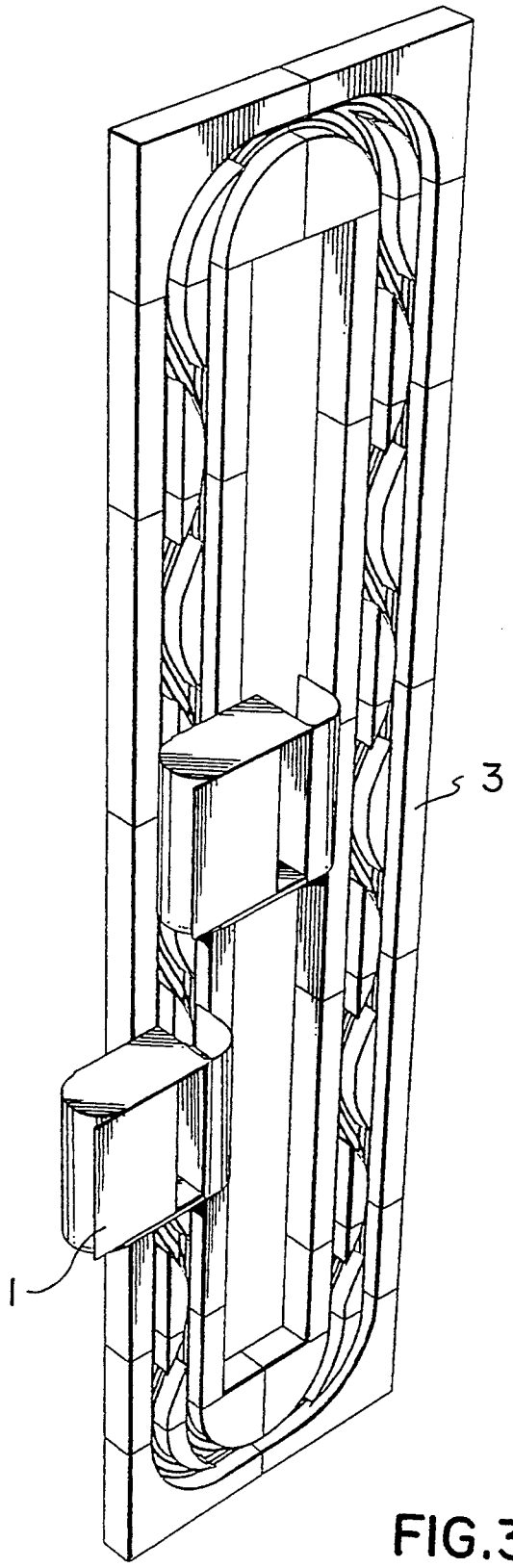
FIG. 33 is a perspective view of a vertical track configuration showing the cabs.
Figure 34:
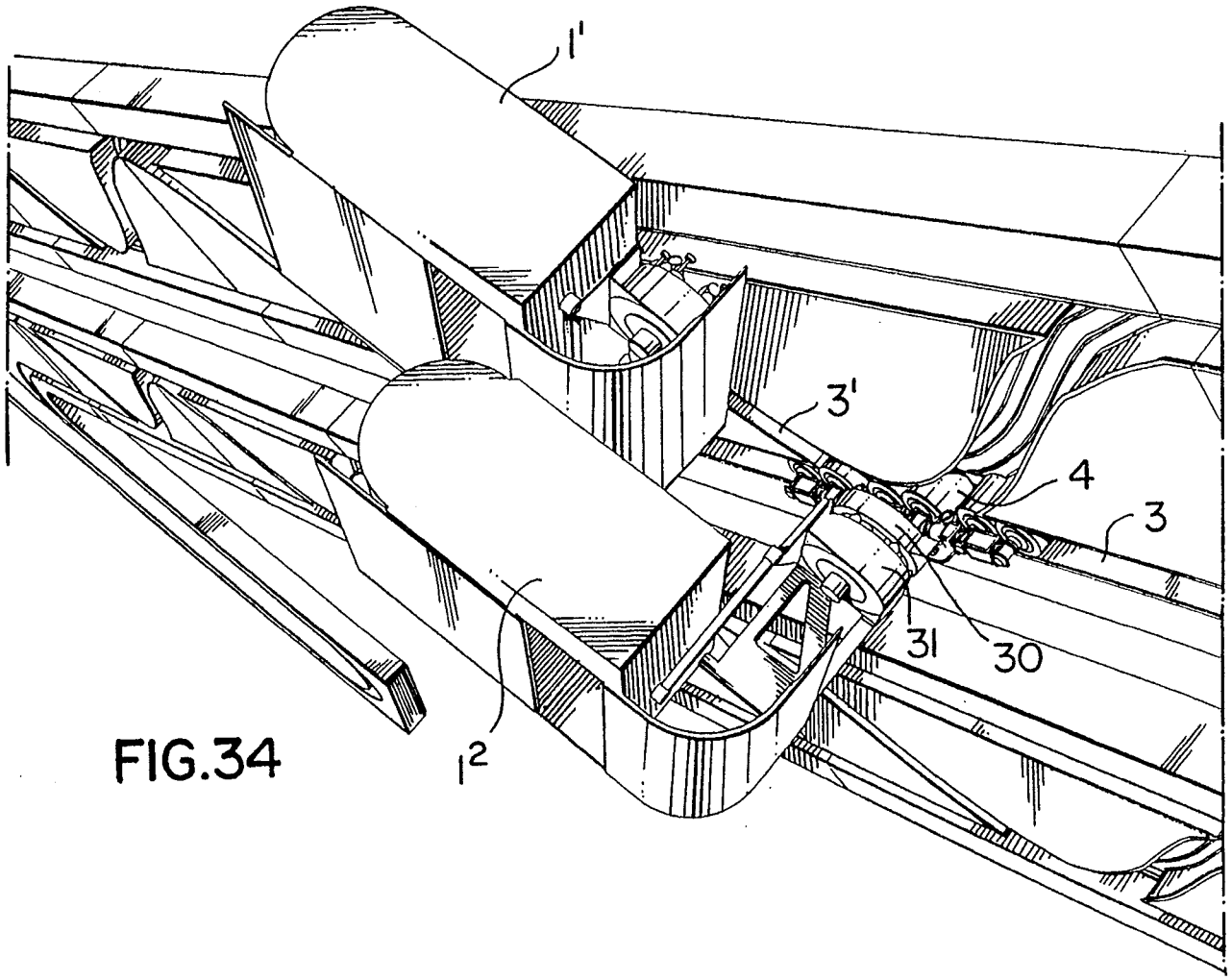
FIG. 34 is a perspective view of a 45 degree track configuration.
Figure 35:
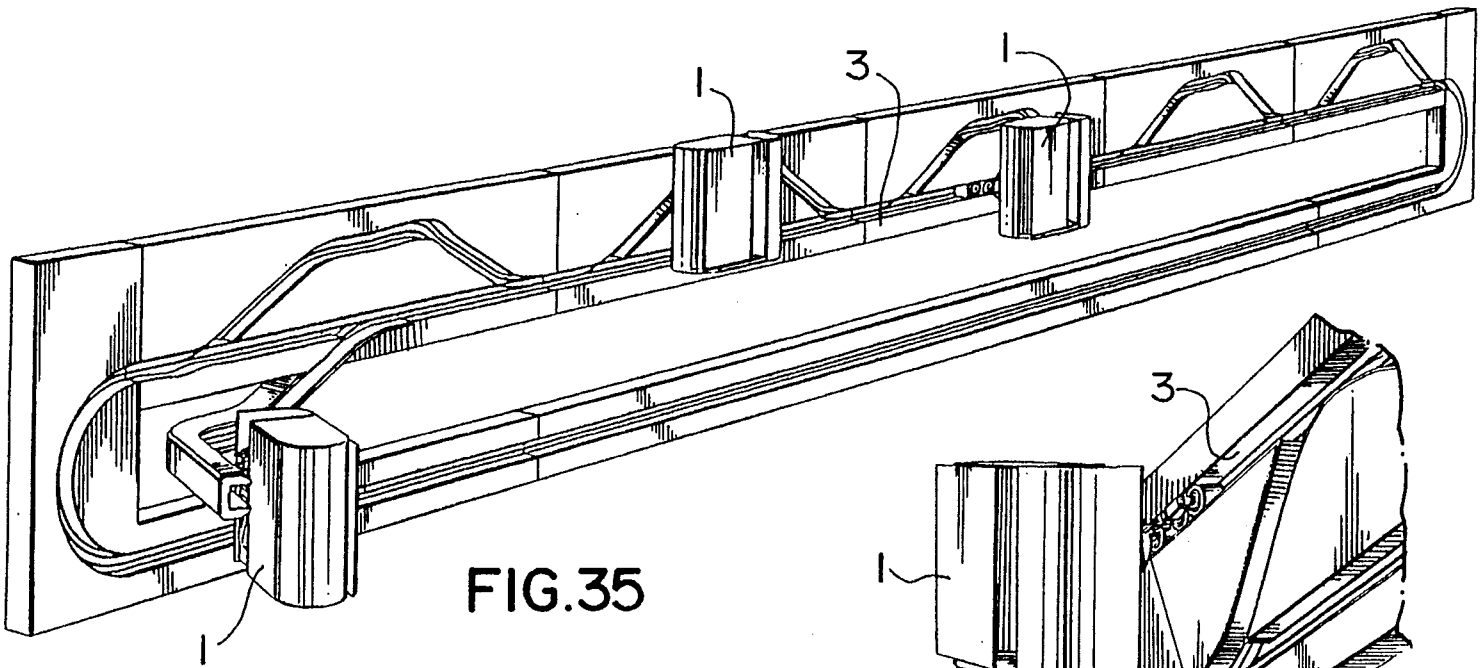
FIG. 35 is a perspective view of horizontal track configuration with a horizontal switch-out.
Figure 36:
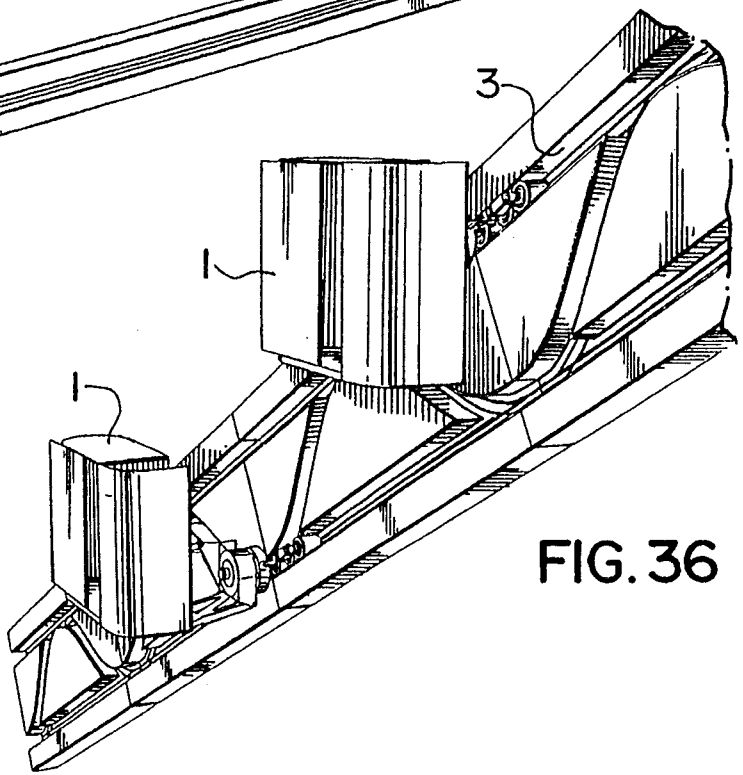
FIG. 36 shows a 30 degree track configuration, with two cabs, one extended and one retracted.
Figure 37:
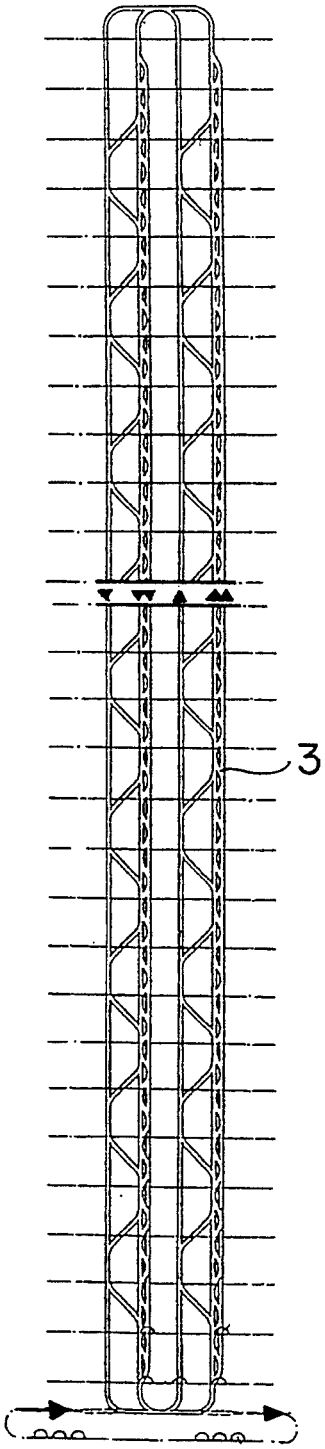
FIGS. 37 and 38 show possible three-track and four-track loop configurations.
Figure 38:
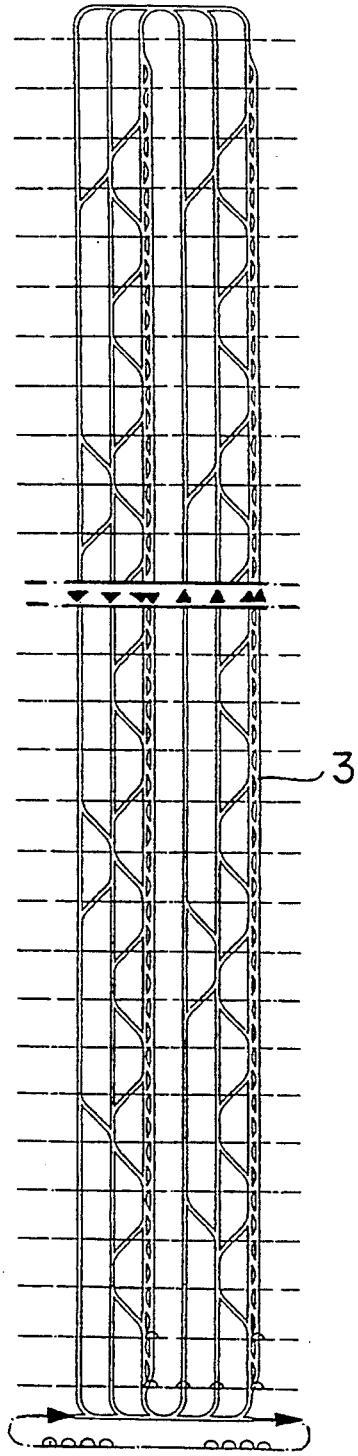
Figure 39:
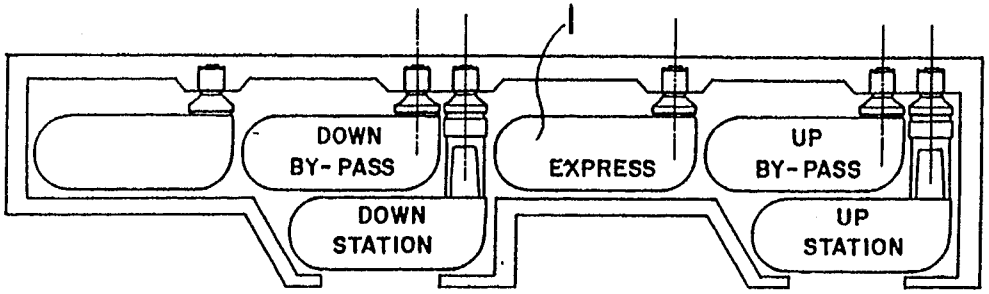
FIG. 39 and 40 show cross-sectional views of vertical three and four-track loop configurations.
Figure 40:
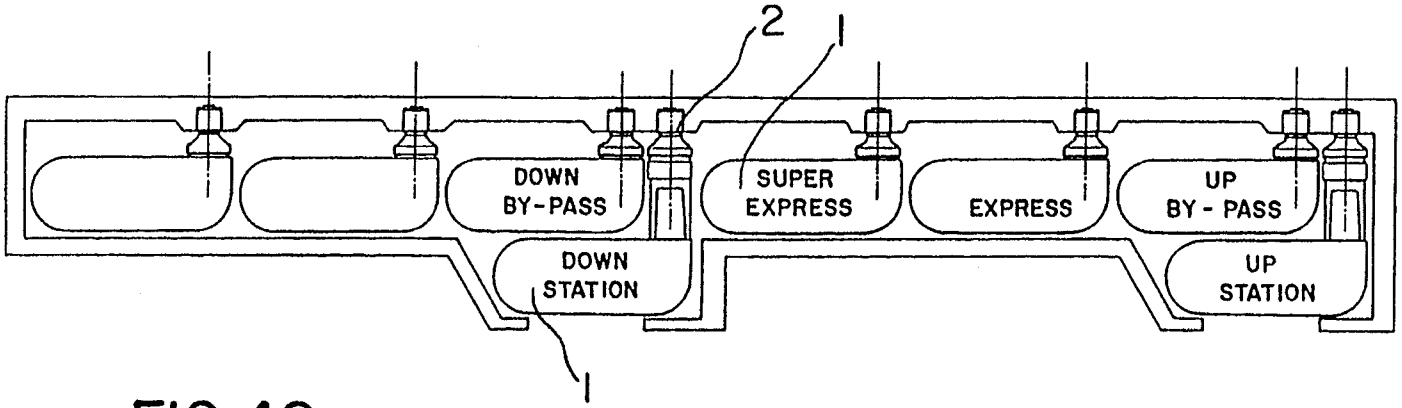

FIGS. 31 and 32 show the positions of the bogies as they switch tracks, and in particular show how the switching can occur without any moving parts on the track itself. The bogies are directed onto the trough-tracks or the switch-out tracks by controlling the hydraulic rams on the bogies.

FIGS. 33 through 40 how various configurations of track and how the cabs can move in three dimensions, and also by being extended outward can overtake one another. For example, in FIG. 34 cabin $1^1$ is in the retracted position and running in switch-out track 3′ while cabin $1^2$ is in the extended position and running in through track 3. The cabins 1 can pass each other without obstruction.

Thus, the described urban transportation system is highly versatile and well-suited to high-density urban development. A common system can be integrated into three dimensional high-rise systems, that allow vertical and horizontal transportation between different office towers. For example, with the described system it is be possible to take a cabin from the seventeenth floor of one high-rise building directly to the twenty-seventh floor of an adjacent facility.

The described system can cover many operational gaps in the present state-of-the-art elevator technology and establish new performance standards for integrated urban transportation. The system operates equally well in all directions: vertical, diagonal, horizontal or combinations thereof. Operating as an elevator (vertical mode) the system utilizes a looped track on which run a multiplicity of self-propelled cabins. By way of example, conventional elevator systems operate twenty cabins in twenty shafts. The described system can operate twenty cabins in two shafts (one up, one down, joined top & bottom to form loop). The system provides station switch-outs with a cabin flow extraction device to allow any cabin to stop at a floor while all the moving cabins can by-pass the stationary cabin unimpeded. This results in "continuous" flow transport with minimal waiting periods and very high carrying capacities.

EXAMPLE

The detailed specifications for a proposed elevator system are as follows:

Cabin: 3'×6' (92 cm×304 cm) 10 passengers (2,000 lbs.)

Cabin open door: 4.5'(137 cm') wide (10 sec. full load cycle) Maximum waiting: 15 seconds (four cycles per minute)

Cabin flow extraction:
- lateral accel., bogie transfer: 2 ft./sec.
- lateral accel., cabin extraction: 2 ft./sec.
- combined motion (overlap): 3 ft./sec.
- full extraction time: 2 seconds
- full insertion time: 2 seconds Cabin drive:
- single traction motor (600 ftlbs/1700 rpm)
- gear transfer drive to bogie
- automatic speed and directional control fail
- safe bogie lock to prevent descent—descent charge-mode for traction motor Max. load/cabin module:
- 3,500 lbs.(cabin structure: 200 lbs. suspension arms & rams: 300 lbs., motors, controls, servo drives, battery: 1,000 lbs.)

Vertical speed max.: 2200 fpm (36.6 fps) (25 mph (660 m/min. or 40 kph)

Horizontal speed: (5280 fpm (88 fps) (60 mph (1560 m/min. or 96 kph)

Weatherproof track system (steel/concrete composite) track cross-section space requirement: 18"×18" (47 cm×47 cm)

Such a system has the following advantages over existing elevators: 50% reduced waiting, double flow capacity, more than double flash flow capacity, 60% less more area, 30% to 40% less installation cos, flexible capacity by varying cabin inventory, maintenance does not reduce service, reduced energy consumption because descent uses motors as generators, greatly expanded scope in design and planning of new buildings (small core), additive megastructure with "Junction zoning".

Example: building size equivalent to one World Trade Tower or Sears Tower:

(1) Conventional systems (state of the art elevators) can move approx. 500 people per min. (ppm) or: 2500 pass.in a five minute interval or 12% building population in 5 min. Waiting period: 20 sec. to 30 sec. Core area: 12% of gross (5760 sqft of 48000 sqft.

(2) The described system can move 1000 people per min. (ppm), 5000 pass.in five min. interval, 24% building population in 5 min. Waiting period: 10 sec. to 15 sec. Core Area: 3% to 4% of gross area. The system thus allows a significant increase in "FLASH EVACUATION CAPACITY" by using five lower levels as exit flow. System capacity varies with number of loops/core and number of cabins/loop.

HORIZONTAL FLOW: 30000 pph, STATION WAIT: 15 sec. to 20 sec., STATION INTERVAL: 300 ft. to 600 ft., INCREASE LOCAL FLOW: Dual or multiple tracking.

I claim:

1. A transportation system comprising a continuous stationary track having a pair of opposed rigid bearing surfaces, and a plurality of discrete cantilevered load-carrying vehicle units movable beside said track, each said vehicle unit being coupled to said track by means of a bogie having a linear arrangement of bogie wheels running between said bearing surfaces, characterized in that said bogie wheels are mounted on mutually articulated frames and have a diameter slightly less than the separation of said opposed bearing surfaces to allow limited pivoting movement of said frames within said track, and urging means for forcibly urging adjacent articulated frames to pivot in opposite directions within said track between said bearing surfaces such that bogie wheels carried thereby forcibly and alternately engage said respective opposed bearing surfaces at at least three points to ensure a pre-loaded positive coupling between said bogie and said track.

2. A transportation system as claimed in claim 1, characterized in that each said frame carries a pair of bogie wheels, and adjacent said frames are arranged such that they are pivotally urged in opposite directions.

3. A transportation system as claimed in claim 2, characterized in that said frames have protruding wing portions, and said urging means extend between the wing portions of adjacent frames.

4. A transportation system as claimed in claim 3, characterized in that said urging means comprise hydraulic rams.

5. A transportation system as claimed in claim 4, characterized in that said frames are interconnected by universal joints to permit lateral relative pivotal movement relative to the direction of movement of the bogie.

6. A transportation system as claimed in claim 5, characterized in that it further comprises means to lock said frames against relative rotational movement about a longitudinal axis parallel to the direction of movement of the bogie.

7. A transportation system as claimed in claim 6, characterized in that said locking means comprise pivotal joint means displaced from a main articulation axis interconnecting adjacent frames in the direction of movement, and further engagement means between said adjacent frames, said further engagement means cooperating with said pivotal joint means to inhibit rotational movement about said main articulation axis and permit rotational movement about two axes orthogonal thereto.

8. A transportation system as claimed in claim 7, characterized in that said further engagement means comprises at least one roller carried by one of said frames, said roller constrained within a guideway fixed relative to the adjacent frame said guideway having opposed bearing surfaces generally parallel to the opposed bearing surfaces of said track for engaging said at least one roller, whereby as said adjacent frames tend to rotate about said main articulation axis, said at least one roller bears against one of said opposed bearing surfaces of said guideway, thus inhibiting said rotational movement.

9. A transportation system as claimed in claim 7, characterized in that said pivotal joint means comprises a steering ball joint.

10. A transportation system as claimed in claim 1, characterized in that it further comprises a drive motor mounted on said bogie, and a drive train for coupling said drive motor to the bogie wheels of said frames.

11. A transportation system as claimed in claim 10, characterized in that said drive train comprises intermeshing bevel gears, and drive is transmitted between adjacent frames by means of a split drive shaft driven thereby, a constant velocity universal joint being interposed said split drive shaft to permit transfer of rotational movement between said adjacent frames while allowing lateral pivotal movement relative to the direction of movement of the bogie.

12. A transportation system as claimed in claim 1, characterized in that said vehicle units are coupled to said bogies by cantilevered coupling means that permit rotation of said vehicle units about an axis perpendicular to the direction of said track to permit said vehicle units to remain vertical as the direction of said track changes between vertical and horizontal orientations.

13. A transportation system as claimed in claim 12, characterized in that said cantilevered coupling means comprise an open drum having an inwardly directed flange defining a bearing surface, and a vehicle unit support member cooperating into said drum, said vehicle unit support member having extension means extending into said drum and supporting outwardly directed roller members bearing against the bearing surface of said inwardly directed flange.

14. A transportation system as claimed in claim 13, characterized in that said flange further includes an outer bearing surface, and said extension supports outer roller members bearing against said outer bearing surface to inhibit pivotal displacement of said vehicle unit support member relative to said bogie while permitting rotational movement about an axis of symmetry thereof.

15. A transportation system as claimed in claim 14, characterized in that said extension means is further coupled to said drum through a ring gear intermeshing with a corresponding gear on said drum.

16. An transportation system as claimed in claim 13 or 14, characterized in that said extension means is provided with servo control means coupled to said ring gear to maintain said vehicle units in the vertical position at all times.

17. A transportation system as claimed in claim 1, characterized in that said vehicle units are connected to said bogies by coupling means of articulated links permitting lateral movement of said vehicle units away from said track.

18. A transportation system as claimed in claim 17, characterized in that said coupling means comprise articulated links.

19. A transportation system as claimed in claim 18, characterized in that said articulated links comprise a parallelogram arrangement constraining said vehicle units for translational movement only.

20. A transportation system as claimed in claim 18, characterized in that said parallelogram arrangements comprise one torsionally rigid primary arm and one secondary positioning arm.

21. A transportation system as claimed in claim 17, characterized in that said coupling means comprise telescoping links.

22. A transportation system as claimed in claim 21, characterized in that said telescoping links are hydraulically driven.

23. A transportation system as claimed in claim 1, characterized in that said bogie wheels are provided with a rubberized traction surface.

24. A transportation system as claimed in claim 23, characterized in that said bogie wheels comprise a central traction tire and flanking sprung support and guide flanges.

25. A transportation system as claimed in claim 24, characterized in that said support and guide flanges comprise sprung steel.

26. A transportation system as claimed in claim 1, characterized in that said opposed bearing surfaces of said track comprise shallow C-shaped channel members defining flanged channels for accommodating said bogie wheels.

27. A transportation system as claimed in claim 1, characterized in that said track further comprises a fail-safe safety mechanism continuously engaging said bogie wheels to provide additional braking in the event of an emergency.

28. An transportation system as claimed in claim 27, characterized in that said safety mechanism comprises a rack and pinion arrangement.

29. A transportation system as claimed in claim 1, characterized in that said track comprises a rigid C-shaped member.

30. A transportation system as claimed in claim 1, characterized in that said vehicle units comprise passenger cabins with at least one end thereof curved, and a sliding door extending over a major portion of one lateral face of said cabin, said sliding door being flexible and in the open position following the curve profile of said curved end thereby to permit access in the open position to said major portion of said one lateral face of said cabin.

31. A transportation system as claimed in claim 30, characterized in that said cabins have a stressed-skin torsion box construction.

32. A transportation system as claimed in claim 1, characterized in that at steeply curved portions of said track an outermost one of said rigid bearing surfaces is formed with a depression to permit passage of said bogie through said steeply curved portion, said urging means maintaining a three-point contact at all times with said opposed bearing surfaces.

33. A transportation system as claimed in claim 1, characterized in that it provides an elevator in a high-rise building, said track being in the form of a vertical oval loop, and said elevator comprising a plurality of said vehicle units forming passenger cabins moving around said loop in the same direction.

34. A transportation system as claimed in claim 33, characterized in that switch tracks are provided at passenger stations, said vehicle units moving onto said switch tracks at said passenger locations to allow following vehicle units to pass while they embark and disembark passengers.

35. A transportation system as claimed in claim 34, characterized in that it further comprises at least one express track bypassing at least some said passenger stations.

36. A transportation system as claimed in claim 1, characterized in that said track comprises generally horizontal and generally vertical branches, said horizontal branches providing transportation between laterally spaced points, and said vertical branches providing elevator transportation within high-rise buildings, whereby passengers can be transported in the same vehicle unit from a laterally displaced location to a selected floor of a remote high-rise building.

37. A transportation system as claimed in claim 1, further comprising a fail-safe locking mechanism comprising rollers located between reaction surfaces respectively on the inside of the track and the inner side of the bogie, one of said reaction surfaces being ramped so that in the event of an emergency the rollers become wedged between the reaction surfaces to provide a braking effect.

* * * * *